US005454648A

United States Patent [19]

Lee

[11] Patent Number: 5,454,648

[45] Date of Patent: Oct. 3, 1995

[54] PRINTER PAPER GUIDE

[75] Inventor: Ghai K. Lee, Singapore, Singapore

[73] Assignee: Hewlett-Packard Company, Palo Alto, Calif.

[21] Appl. No.: 233,794

[22] Filed: Apr. 26, 1994

[51] Int. Cl.[6] ..... B41J 11/06

[52] U.S. Cl. ..... 400/48; 400/645; 271/240

[58] Field of Search ..... 400/48, 23, 642, 400/545, 645.1; 101/407.1, 474, 416.1, 419, 420; 355/75, 321, 308, 309; 271/240

[56] References Cited

U.S. PATENT DOCUMENTS

| | | | |
|---|---|---|---|
| 1,780,348 | 11/1930 | Eckhard | 271/240 |
| 3,129,802 | 9/1961 | Engle | 400/645 |
| 5,086,313 | 2/1992 | Aoki | 355/308 |
| 5,091,754 | 2/1992 | Abe et al. | 355/308 |
| 5,168,290 | 12/1992 | Tanaka et al. | 355/308 |

FOREIGN PATENT DOCUMENTS

| | | | |
|---|---|---|---|
| 3190770 | 8/1991 | Japan | 400/642 |

*Primary Examiner*—Edgar S. Burr
*Assistant Examiner*—Anthony H. Nguyen

[57] ABSTRACT

A paper guide includes a wing that extends over a respective lateral edge of the print media and a dimple formed on a bottom side of the wing that contacts the print media between the respective lateral edge and an edge of the maximum printable area. The dimple separates the print media from the wing so as to avoid smearing the ink in the maximum printable area. Two embodiments of the dimples are shown. A first embodiment of the dimple includes a central elongate portion having first and second hemispherical portions at respective ends thereof. The second embodiment is a substantially semi-hemispherical shaped dimple. The second embodiment can operate either by itself or in conjunction with a second substantially identical semi-hemispherical dimple.

18 Claims, 2 Drawing Sheets

PRINTER PAPER GUIDE

BACKGROUND OF THE INVENTION

This invention relates generally to inkjet printers and more particularly to paper guides therefor.

A well known problem in inkjet printers is so-called "paper curl." Paper curl occurs due to the absorption of the liquid ink by the print media. This problem is especially prevalent in low humidity environments in which the print media is especially dry. Paper curl is somewhat of a misnomer, however, because transparencies as well as paper suffer from the paper curl problem.

The paper curl problem is illustrated in FIG. 1. In FIG. 1, a sheet of paper 10 is shown being fed out of an inkjet printer on a printer platen 12. The paper feed mechanism and printing mechanism are not shown for simplicity. As can be seen from FIG. 1, lateral edges 14 and 16 of the sheet 10 are bowed upwards away from the platen. The severity of the paper curl is determined by, among other things, the print time and the amount of ink deposited on the print media. The longer the print time and the more ink deposited, the more curl that occurs. Therefore, paper curl is especially pronounced in color printers which require multiple inks to be deposited to form a composite images. If the paper curl becomes too severe, the leading edge of the paper, shown coming out of the page in FIG. 1, can catch on a portion of the structure defining the paper path and become "jammed" inside the printer.

Referring now to FIG. 2, prior art paper guides 18 and 20 have been used to constrain the paper curl to an acceptable level. The paper guides 18 and 20 are mounted on the platen on opposite sides thereof to constrain a respective lateral edge of sheet 10.

Paper guide 20 is shown in more detail in FIG. 3. It can be seen in FIG. 3 that the lateral edge 16 of sheet 10 rides along the underside of paper guide 20. Because the paper contacts the paper guide, if there is printing on the sheet 10 in the area that contacts the paper guide, the printing will be smeared by the paper guide if the ink is not yet dry. To avoid this possibility, printers have constrained themselves from printing in the area on the paper that contacts the paper guide, i.e. the so-called "smear area." Thus, valuable printing space is given up in order to solve the paper curl problem. The amount of area given up can be significant if the paper guides are properly designed to account for paper misalignment and variation in paper widths. Accordingly, a need remains for a paper guide that can operate in worst-case operating conditions and yet has a larger maximum printable area.

SUMMARY OF THE INVENTION

It is, therefore, an object of the invention to minimize paper curl to an acceptable level in an inkjet printer. Another object of the invention is to increase the maximum printable area of an inkjet printer.

According to the invention, a paper guide is provided which maintains paper curl to an acceptable level under even worst-case misalignment conditions while increasing the maximum printable area available to the printer. The paper guide according to the invention includes a wing that extends over the respective lateral edge of the print media and a dimple formed on a bottom side of the wing that contacts the print media between the respective lateral edge and an edge of the maximum printable area to separate the print media from the wing so as to avoid smearing the ink in the maximum printable area. Two embodiments of the dimples are shown. A first embodiment of the dimple includes a central elongate portion having first and second hemispherical portions at respective ends thereof. The second embodiment is a substantially semi-hemispherical shaped dimple. The second embodiment can operate either by itself or in conjunction with a second substantially identical semi-hemispherical dimple. The foregoing and other objects, features and advantages of the invention will become more readily apparent from the following detailed description of a preferred embodiment of the invention which proceeds with reference to the accompanying drawings.

DETAILED DESCRIPTION

Figure 1:
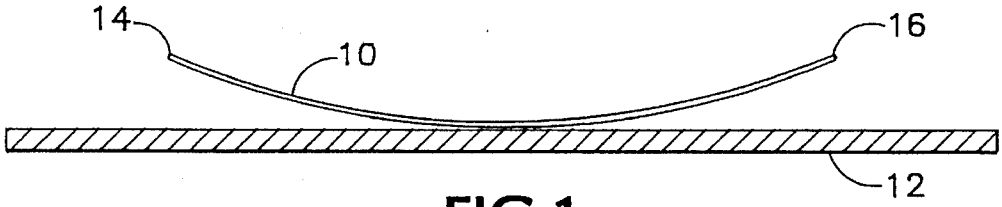
FIG.1 (PRIOR ART)
FIG. 1 is a front view of a sheet of paper having excessive paper cud being fed along a printer platen in an inkjet printer.
Figure 2:
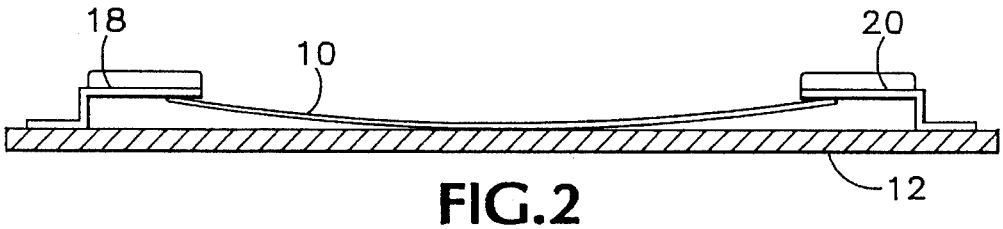
FIG.2 (PRIOR ART)
FIG. 2 shows the printer of FIG. 1 having prior art paper guides disposed on opposite lateral sides of the platen for maintaining the paper cud within an acceptable range.
Figure 3:
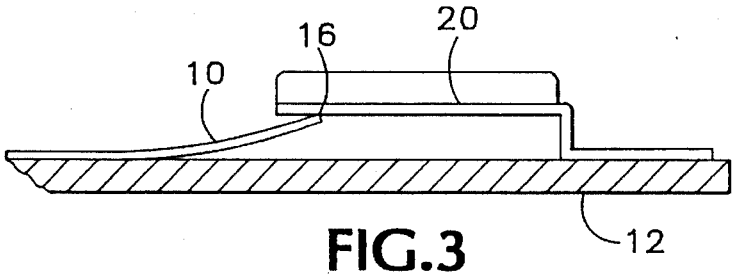
FIG.3 (PRIOR ART)
FIG. 3 is an elevation view of the paper guide of FIG. 2 showing the paper edge riding along the underside of the paper guide.
Figure 4B:
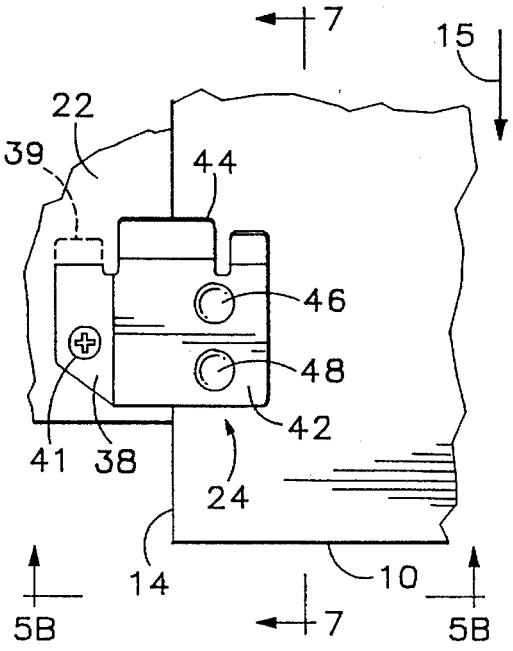
FIG. 4B is a top plan view of a second embodiment of the paper guides according to the invention.
Figure 4A:
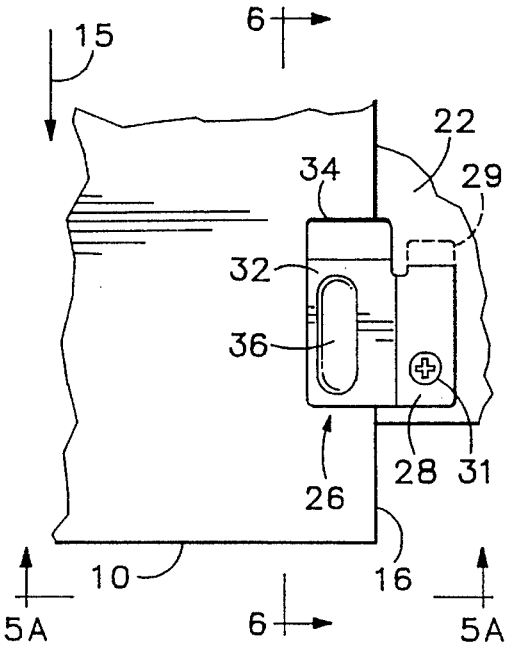
FIG. 4A is a top plan view of a first embodiment of the paper guides according to the invention.

Referring now to FIGS. 4A–4B, paper guides 24 and 26 according to the invention are shown mounted on a portion of an inkjet printer paper path. The paper path includes a platen 22 along which the print media is fed during printing. An arrow 15 indicates the direction of movement of the print media along the platen 22. Mounted on the platen 22 are paper guides 24 and 26. Paper guide 24 is mounted on the left side of the platen 22 to receive a respective lateral edge 14 of sheet 10. Paper guide 26 is mounted on the right side of the platen 22 to receive the respective lateral edge 16 of sheet 10. Paper guides 24 and 26 are aligned along an axis that is substantially perpendicular to axis 15 and parallel to platen 22.

Two different embodiments of the paper guides are shown in FIGS. 4A–4B for illustrative purposes, i.e., paper guides 24 and 26. Each embodiment is described in more detail below. In normal use, however, the two paper guides will employ only one of the embodiments at a time. The paper guides 24 and 26 are, in the preferred embodiment, made of sheet metal. However, any other rigid or semi-rigid material such as plastic can be used.

Figure 5A:
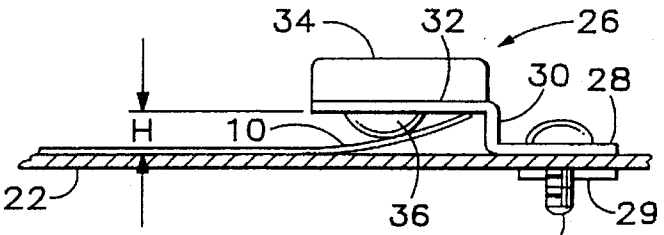
FIG. 5A is an elevation view viewed along lines 5A—5A in FIG. 4A.
Figure 6:
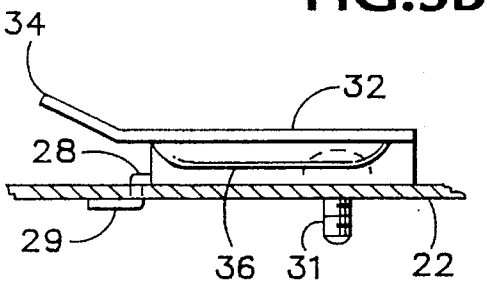
FIG. 6 is an elevation view viewed along lines 6—6 of FIG. 4A.

Referring also to FIGS. 5A and 6, paper guide 26 includes a contact plate 28 mounted on the platen 22. The contact plate 28 further includes a tab 29 that is received in a slot (not visible) in the platen 22. The contact plate is secured to the platen 22 by a screw 31. A vertical extension member 30 is connected to the contact plate and is perpendicular thereto. The height "H" of the vertical extension member is determined by the acceptable amount of paper curl. A horizontal extension member 32, or "wing" is connected to the vertical member 30 and extends out over the edge of the maximum printable area of sheet 10. A flange 34 is connected to the wing 32 and is angularly offset therefrom for guiding the print media into the paper guide 26. Paper guide 26 further includes an elongate dimple 36 formed on a bottom side of wing 32. Dimple 36 is actually a depression formed in wing 32. Alternatively, a separate dimple structure can be attached to the bottom side of wing 32.

Figure 5B:
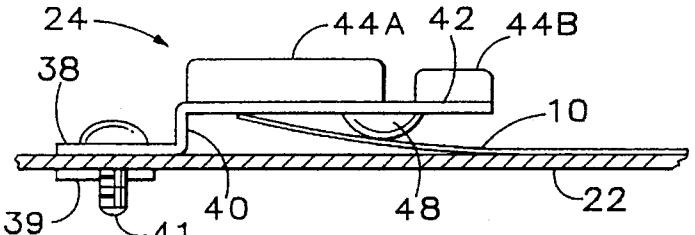
FIG. 5B is an elevation view viewed along lines 5B—5B in FIG. 4B.
Figure 7:
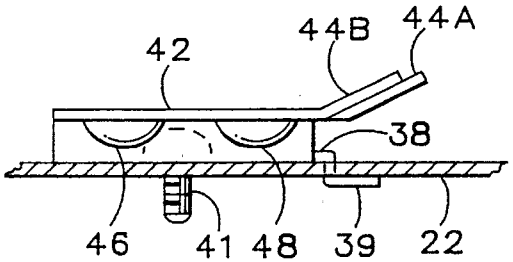
FIG. 7 is an elevation view viewed along lines 7—7 of FIG. 4B.

Referring now to FIGS. 5B and 7, an elevation of paper guide 24 is shown. Paper guide 24 is a mirror image of paper guide 26 with the noticeable exception of the dimple arrangement. Like paper guide 26, paper guide 24 includes a contact plate 38, a vertical extension member 40, a horizontal extension member or "wing" 42, and a flange 44 (including flanges 44A and 44B). Contact plate 38 also includes a tab 39 that is received in a corresponding slot (not visible) in the platen 22. Contact plate 38 is further secured to the platen 22 by screw 41.

Unlike paper guide 26, however, paper guide 24 includes two dimples 46 and 48. The dimples 46 and 48 are substantially semi-hemispherical, in contrast to the elongate dimple of paper guide 26. The dimples 46 and 48 are, in the preferred embodiment, depressions formed in wing 42. Alternatively, dimples 46 and 48 could be separate structures connected to the bottom side of wing 42. The flange 44 of paper guide 26 also differs from the flange 34 of paper guide 26. The flange 44 includes two separate flanges 44A and 44B.

Figure 8A:
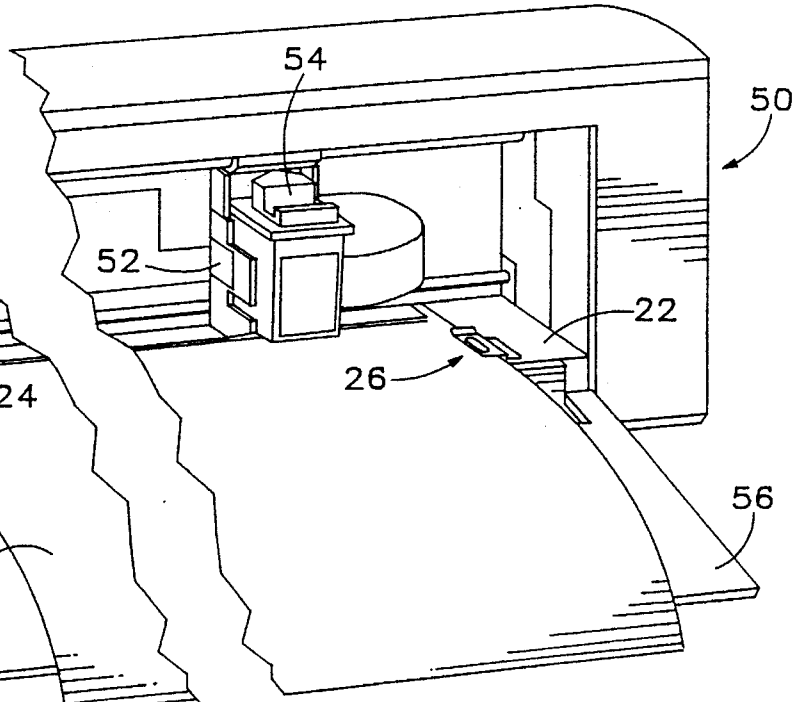
FIG. 8A is a cut-away perspective view of an inkjet printing unit having the paper guide of FIG. 4A according to the invention mounted therein.
Figure 8B:
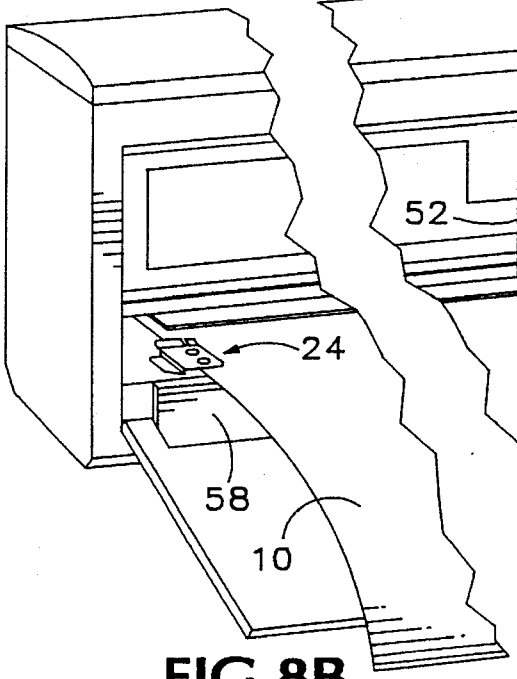
FIG. 8B is a cut-away perspective view of an inkjet printing unit having the paper guide of FIG. 4B according to the invention mounted therein.

The paper guides 24 and 26 are shown installed in an actual printing unit in FIGS. 8A–8B. The printing unit shown is described in commonly assigned application Ser. No. 07/887,517, filed May 19, 1992, incorporated herein by reference. The printing unit shown is representative of the type of printer in which the paper guides can be incorporated in. The invention, however, is not limited to the type of printing unit shown in FIGS. 8A–8B. The paper guides according to the invention can be mounted on any output platen or output tray of an ink jet printer.

The printing unit 50 shown in FIGS. 8A–8B includes a carriage 52 adapted to receive an ink cartridge 54. The carriage moves along a printing axis while the paper is advanced along the printer paper path. The paper is advanced by rollers (not visible) past the cartridge 54 towards an opening formed between door 56 and casing 58 when the door 56 is closed. The door is shown open to expose the paper guides. The paper guides 24 and 26 are disposed along the paper path so as to catch respective lateral edges of the paper to restrain the paper curl to allow the paper to be fed through the opening. Without the paper guides the upwardly bowed edges of the curled paper would catch on the door 56.

In operation, the dimples contact the sheet between the maximum printable area and the respective lateral edge of the sheet. The maximum printable area is the area on the print media within which the printer can deposit ink. The dimple separates the maximum printable area from the corresponding wing so as not to smear the print. It should be apparent that the dimples thus increases the maximum printable area of the printer as compared to a flat paper guide.

Having described and illustrated the principles of the invention in a preferred embodiment thereof, it should be apparent that the invention can be modified in arrangement and detail without departing from such principles. For example, it is apparent that the two paper guides can be used in any combination thereof, i.e., two paper guides 24 or two paper guides 26. In addition, the number and size of the dimples can be modified without departing from the inventive principle taught herein. I claim all modifications and variation coming within the spirit and scope of the following claims.

I claim:

1. A paper guide connectable to a platen in an inkjet printer, the printer being adapted to receive print media having lateral paper edges that move along the platen and having maximum printable area defined by the printer within which the ink must be applied to the media, the paper guide comprising:

a wing having a top side and a bottom side and connected to the platen, the wing extending over the printable area of the print media when the paper guide is connected to the platen; and a first dimple projecting from the bottom side of the wing between where the paper edge passes under the wing and where the printable area passes under the wing such that the dimple contacts the print media between the printable area and the paper edge and separates the printable area from the wing to avoid smearing the ink.

2. A paper guide according to claim 1 wherein the dimple has a hemispherical cross-section.

3. A paper guide according to claim 1 wherein the dimple includes:

a central elongate portion having a first end and a second end;

a first hemispherical portion at the first end of the central elongate portion; and a second hemispherical portion at the second end of the central elongate portion.

4. A paper guide according to claim 1 further comprising a second dimple formed on the bottom side of the wing.

5. A paper guide according to claim 4 wherein the first and second dimples are substantially semi-hemispherical.

6. A paper guide according to claim 1 wherein the paper guide further includes a flange connected to one side of the wing and angularly offset from the wing for guiding the print media into the paper guide.

7. A paper guide according to claim 6 wherein the flange is angularly offset from the wing by an acute angle.

8. A paper guide according to claim 1 wherein the wing includes:

a contact plate;

a first extension member having a first end and a second end, the vertical extension member being connected to the contact plate at the first end; and a second extension member connected to the second end of the first extension member and extending away from the contact plate and over the printable area of the print media when the paper guide is connected to the platen.

9. A paper guide according to claim 8 wherein the contact plate and the second extension member are substantially parallel.

10. A paper guide according to claim 8 wherein the contact plate includes a tab for securing the wing to the platen.

11. An inkjet printer for printing on print media which moves through the printer along a paper path, the print media having lateral paper edges and a maximum printable area defined by the printer within which the ink must be applied to the media, comprising:

a platen interposed along the paper path;

first and second paper guides mounted on the platen and extending over the paper path, each paper guide including:

a wing having a top side and a bottom side and connected to the platen, the wing extending over the printable area of the print media as the print media moves along the paper path, and means projecting from the bottom side of the wing for separating the printable area from the wing to avoid smearing ink deposited therein.

12. A printer according to claim 11 wherein the first and second paper guides are mounted on the frame on respective, opposite sides of the platen.

13. A printer according to claim 12 wherein the first and second paper guides are aligned along an axis that is perpendicular to the direction of movement of the media along the paper path.

14. A printer according to claim 11 wherein the means projecting from the bottom side of the wing for separating the printable area from the wing of the first paper guide includes:

a central elongate portion having a first end and a second end;

a first hemispherical portion at the first end of the central elongate portion; and a second hemispherical portion at the second end of the central elongate portion.

15. A printer according to claim 11 wherein the means projecting from the bottom side of the wing for separating the printable area from the wing of the second paper guide includes:

a first dimple projecting from the bottom side of the corresponding wing; and a second dimple, separated from the first dimpled, projecting from the bottom side of the corresponding wing.

16. A paper guide according to claim 15 wherein the dimples are a depression in the corresponding wing.

17. A paper guide according to claim 16 wherein paper guides are made of sheet metal.

18. A method of printing in a low humidity environment comprising:

supplying print media having lateral paper edges to an inkjet printer;

moving the print media along a paper path in the printer;

depositing ink on the print media within a maximum printable area defined by the printer whereby the print media develops an upward bow due to the absorption of the ink in the low humidity environment;

moving the print media into a pair of opposed paper guides having wings which overlap the lateral paper edges and a portion of the printable area; and providing projecting dimples on the side of said wings which face said print media and positioning said dimples to contact the print media between the printable area and the paper edge and depressing the print media with said dimples so as to oppose the upward bow of the print media while not smearing the ink.

* * * * *